United States Patent [19]

Wellington et al.

[11] Patent Number: 4,722,394

[45] Date of Patent: Feb. 2, 1988

[54] DETERMINING RESIDUAL OIL SATURATION BY RADIOACTIVELY ANALYZING INJECTED $CO_2$ AND BASE-GENERATING TRACER-PROVIDING SOLUTION

[75] Inventors: Scott L. Wellington; Edwin A. Richardson, both of Houston, Tex.

[73] Assignee: Shell Oil Company, Houston, Tex.

[21] Appl. No.: 873,555

[22] Filed: Jun. 12, 1986

[51] Int. Cl.[4] ..... E21B 47/00

[52] U.S. Cl. ..... 166/250; 73/155; 166/300; 436/27; 436/57

[58] Field of Search ..... 166/250, 252, 270, 300; 73/155; 436/27, 28, 29, 56, 57

[56] References Cited

U.S. PATENT DOCUMENTS

| | | | |
|---|---|---|---|
| 2,553,900 | 5/1951 | Doan et al. | 436/56 X |
| 2,947,359 | 8/1960 | Josendal et al. | 166/250 |
| 3,426,205 | 2/1969 | Acree et al. | 436/56 X |
| 3,590,923 | 7/1971 | Cooke, Jr. | 166/252 |
| 3,623,842 | 11/1971 | Deans | 166/252 X |
| 3,788,814 | 1/1974 | Goldblatt et al. | 436/56 X |
| 3,856,468 | 12/1974 | Keller | 166/252 X |
| 3,894,584 | 7/1975 | Fertl | 166/250 |
| 4,085,798 | 4/1978 | Schweitzer et al. | 166/252 |
| 4,273,187 | 1/1981 | Satter et al. | 166/252 |
| 4,562,158 | 12/1985 | Schellenberg | 436/57 |
| 4,617,994 | 10/1986 | Richardson | 166/250 |

*Primary Examiner*—George A. Suchfield

[57] ABSTRACT

Residual oil saturation is determined by injecting water containing $CO_2$, a base-generating material and at least one radioactively labeled material which is or becomes a selectively water-soluble tracer material mixed with the injected $CO_2$, so that the arrival of the oil and water-partitioning tracer material is demarked by a decrease in $CO_2$ concentration and the arrival of at least one of tracer material detected by a radioactivity analysis.

11 Claims, 3 Drawing Figures

DETERMINING RESIDUAL OIL SATURATION BY RADIOACTIVELY ANALYZING INJECTED $CO_2$ AND BASE-GENERATING TRACER-PROVIDING SOLUTION

RELATED APPLICATIONS

This application is related to the commonly assigned patent applications Ser. Nos. 800,849, now U.S. Pat. No. 4,646,832 and 800,852, now U.S. Pat. No. 4,617,994 filed Nov. 22, 1985 by E. A. Richardson, on determining residual oil saturation by, respectively, injecting carbonic acid salt and an acid-generating material, or $CO_2$ and base-generating material, and to our commonly assigned and concurrently filed patent application Ser. No. 899,685 relating to determining residual oil saturation by injecting a solution containing selectively water soluble carbonic acid salt, acid-generating salt and radioactively labeled water tracer. The disclosures of those applications are incorporated herein by reference.

BACKGROUND OF THE INVENTION

This invention relates to determining the relative concentrations of oil and water phase fluids within subterranean reservoirs by measuring the chromatographic separation of tracers having distinctly different partitioning coefficients in between the oil and water phases of the fluids within the reservoirs. More particularly, the present invention relates to improving a process for making such determinations by injecting a $CO_2$-containing aqueous solution of reactants arranged to contain or provide a depletion of the $CO_2$ concentration to serve as an immobile-fluid-tracer and a selectively water-miscible, radioactive mobile-fluid-tracer, in a manner such that radiation detection can be used for determining the chromatographic separation between the tracers.

A method for determining the relative amounts of water and oil fluid phases within a subterranean reservoir by injecting carrier fluid containing a reactant, such as ethyl acetate, capable of forming at least two tracers which have different partitioning coefficients between the carrier fluid and the oil phase and measuring the chromatographic separation of the tracers, was described in 1971 in U.S. Pat. Nos. 3,590,923 and 3,623,842. U.S. Pat. No. 3,751,226 by R. J. Hesse and R. F. Farmer relates to improving such a process by injecting a solution in which the traceer forming reactant is a hydrolyzable beta-keto ester such as ethylacetolacetate. U.S. Pat. No. 3,847,548 relates to improving such a process by injecting carrier fluid containing tracers which partition differently in respect to temperature changes and injecting that fluid at a temperature different from the reservoir temperature. U.S. Pat. No. 3,856,468 relates to improving such a process by injecting carrier fluid containing both a precursor which forms a tracer material that partitions between the fluid phases and a tracer material which is inert and substantially completely dissolved in the mobile phase. U.S. Pat. No. 3,990,298 relates to improving such a process by injecting a carrier fluid containing a plurality of precursors each of which forms a tracer which has a distinctive partition coefficient with at least one mobile fluid phase within the reservoir. U.S. Pat. Nos. 4,099,565 and 4,165,746 relate to uses of such a fluid saturation determining process for evaluating the effectiveness of a design process for recovering oil.

U.S. Pat. No. 4,122,896 by R. F. Scheuermann, E. A. Richardson and C. C. Templeton relates to acidizing a reservoir by injecting an aqueous solution of halocarboxylic acid salt so that the rate of the acidization is limited to the rate of its hydrolysis. The disclosures relating to hydrolysis of halocarboxylic acids contained in that patent are incorporated herein by reference.

SUMMARY OF THE INVENTION

The present invention relates to improving a process in which a reactant-containing aqueous solution is injected into and displaced within a subterranean reservoir in order to contact the reservoir oil with an aqueous solution of tracers having different partition coefficients relative to the oil and water fluid phases within the reservoir, with the chromatographic separation of the tracers being utilized for determining the relative saturations of those fluid phases. The present improvement is provided by injecting into the reservoir a first aqueous solution which at least soon after entering the reservoir contains solutes including or becoming inclusive of at least one each of (a) a detectable radioactively labeled material (b) a detectable concentration of dissolved $CO_2$, (c) sufficient selectively water-miscible reactive material for subsequently increasing the solution pH and thus causing a significant proportion of dissolved $CO_2$ to be converted to dissolved bicarbonate ion, and (d) a detectable concentration of selectively water-soluble water tracer material. The first injected aqueous solution is displaced to a selected location within the reservoir by injecting an aqueous solution which contains substantially the same concentration of $CO_2$ which was present in the first injected solution prior to the $CO_2$ conversion reaction, but contains none of the radioactive, reactive, or tracer materials. The $CO_2$ conversion reaction is allowed to occur. Fluid is then produced from the reservoir and the concentration of the water and the oil fluid phases in the reservoir is determined on the basis of a radioactive measurement of the chromatographic separation between the arrivals of the depletion in $CO_2$ concentration that was induced by the $CO_2$ conversion and the arrival of at least one water tracer material.

DESCRIPTION OF THE INVENTION

Figure 1:
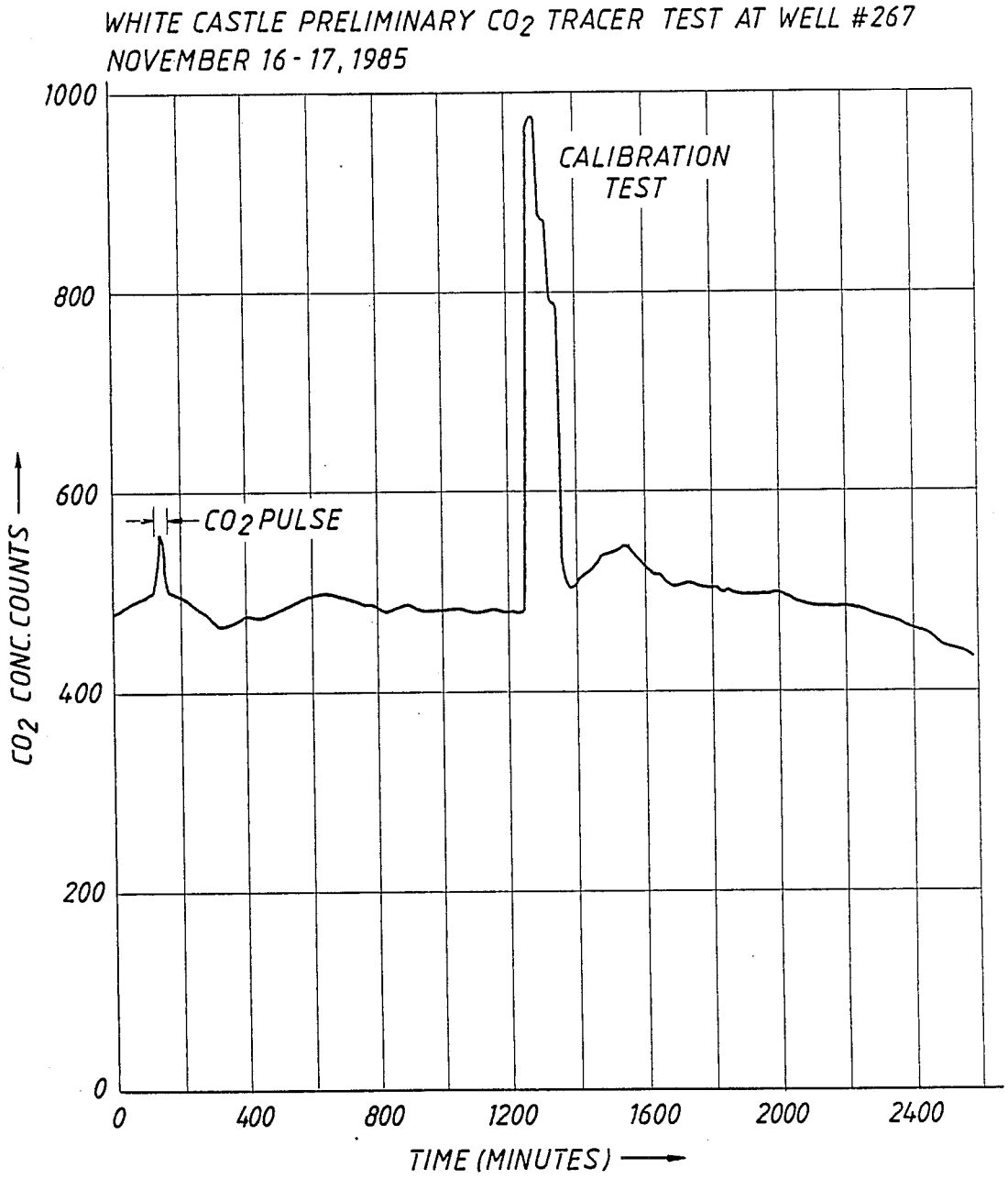
FIG. 1 is a graph of concentration of $CO_2$ in brine produced from a well.

It appears that, in conventional testing operations, the only tracer-forming reactants which have heretofore been successfully used have been hydrolyzable lower alkyl carboxylic acid esters such as those described in U.S. Pat. No. 3,623,842, or the analogous beta-ketoalkyl carboxylic acid esters, which are capable of providing an unreacted ester or ketone as the tracer which is patitioning between the water and oil and a tracer such as alcohol which is substantially completely dissolved in the water phase. Such prior processes have received wide industry acceptance as a "single well tracer method" and more than a hundred jobs have been done. But, in general, the dependance upon organic esters has limited the use of the method to reservoirs having moderate temperatures.

Relative to using untagged tracers such as those described in patent applications Ser. Nos. 800,849 and 800,852, the present invention is, at least in part, based on Applicants' discovery that, particularly in reservoirs containing significant proportions of $CO_2$ or soluble carbonate minerals, those processes can be improved significantly by including radioactively tagged water tracers or precursors of such tracers, with the radioactive materials being used in concentrations too small to require licenses for disposal. However, uses of certain of the available and generally useful radioactively labeled tracers or ways of generating such tracers can cause problems which were not previously expected.

Applicants discovered that—although radioactive tracer materials and measuring equipment are generally available and known to be useful for particularly rapid and accurate determinations of arrivals of radioactive tracer compounds—in a process for measuring residual oil saturation by using $CO_2$ as an oil tracer, the advantages of such radioactive measurements are highly effective if, but only if, the radioactivity measurement is employed in a particular way. It should be used to detect the arrival of the water tracer but not the oil tracer except in a situation where there is no bicarbonate ion in the reservoir brine or in the brine that is injected into the reservoir prior to the injection of the tracer containing slug and that sufficient brine devoid of bicarbonate must be injected prior to the tracer slug so that convective mixing with brine containing bicarbonate ions does not interfere with the results.

In view of this, although carbonic acid salts containing $C_{14}$ labeled carbon atoms can readily be used to form $C_{14}$ labeled $CO_2$, if that $CO_2$ is utilized as an oil tracer, the detection of its radiation may not be coincident with the arrival of the $CO_2$ that is chromatographically delayed between the oil and water phases; except in the situation described above.

In an aqueous solution containing dissolved $CO_2$, the dissolved gas is converted into ions of carbonic acid and those ions are converted into the dissolved gas at rates maintaining proportions of gas and ions responsive to the pressure and temperature of the solution. When such a solution contacts an oil, some water-dissolved $CO_2$ becomes dissolved in oil and some oil-dissolved $CO_2$ becomes dissolved in water, at rates, and to extents, maintaining the partitioning coefficient between the oil and water. In such a situation, if the $CO_2$ contains radioactively tagged carbon atoms and $CO_2$-containing solution is displaced relative to the oil, some of the tagged carbon atoms in the ions of carbonic acid are displaced along with the water and the arrival of the radiation from those ions does not demark the arrival of the $CO_2$ which was delayed by being partitioned between the oil and water phases; except in the case described above where the $CO_2$-displacing solution is at least substantially free of dissolved bicarbonate ions.

In a field test in which a reactant-containing aqueous solution and brine were injected into a reservoir and produced by gas lifting, it was found that adequate amounts of $CO_2$ remained in the brine after the gas-lifting operation. It was also found that the amount of $CO_2$ in the brine did not change significantly or radically during the gas-lift production.

In a field test within a reservoir expected to contain oil and residual oil saturation to water, salts of cabonic and halocarboxylic acids were injected to form a $CO_2$ oil tracer and provide an acid anion water tracer. An on-line wellhead connected analysis system was operated continuously for 48 hours. The $CO_2$ concentration in the brine was quite stable, varying only between about 0.003 to 0.004 moles/liter (i.e., 400 to 600 counts).

The $CO_2$ analysis results are plotted in FIG. 1. The $CO_2$ tracer pulse for determining residual oil saturation can be designed to exceed the base line $CO_2$ concentration by a factor of about 5, and can be easily identified. During the test no special efforts were made to adjust or regulate the gas lift to maintain a constant production rate. As a matter of record, there were several large pressure gas flow rate excursions amounting to $\pm 50\%$ of the average noted on the field gas pressure flow meter during the test.

An ultra-mini $CO_2$ pulse was injected into the gas/liquid separator to see if its presence could be detected. The resulting concentration peak was symmetrical and well defined. It is identified on FIG. 1 just short of the 200 minute line. This test indicated that the monitoring procedure is quite sensitive to the presence of $CO_2$.

An acutal $CO_2$ pulse response would be similar in height and broader than the calibration test pause appearing just behind the 1200 minute time line on FIG. 1. The preliminary test results indicated that the tracer detection procedures are substantially immune to variations in fluid production rate by gas lifting. In fact, the preliminary test results indicate that it may be easier to monitor wells which are produced by gas lift than those produced with a sucker rod pump.

In general, the present invention comprises a process for determining relative concentrations of fluid in the reservoir which method is suitable for substantially any of the uses proposed for the prior methods mentioned above and is suitable for use at much higher temperatures. The present invention is improved relative to those prior processes by (1) using carbon dioxide as the tracer that partitions between the immobile oil phase and the mobile water phase and (2) using a reaction-induced depression of the dissolved $CO_2$ concentration and a concurrently-induced elevation of dissolved bicarbonate ion concentration or other water tracer concentration as at least two markers of the chromatographic separation by which the relative amounts of the fluid phases within the reservoir can be determined.

The present use of a depression (rather than an elevation) in the concentration of an oil phase tracer material in conjunction with at least one radioactively tagged marker for determining the extent of chromatographic separation, appears to be novel. It involves a mechanism which is or appears to be, the following: as the pH of the injected fluid containing both a pH-increasing reactant and dissolved $CO_2$ is increased, the carbonic acid, which is inherently in equilibrium with the dissolved $CO_2$ is neutralized to form dissolved bicarbonate ion. This shifts the equilibrium and results in converting additional dissolved $CO_2$ to dissolved bicarbonate ion. When the resultant $CO_2$-depleted and bicarbonate ion-enhanced solution is flowed through the reservoir formation, the transport of the wave of depleted $CO_2$ concentration is delayed relative to that of the wave of increased bicarbonate ion and/or radioactively tagged water tracer concentration, due to the leaching or eluting of $CO_2$ from the oil. When a relatively $CO_2$-rich oil is contacted by the relatively $CO_2$-poor aqueous fluid, it transfers $CO_2$ into that fluid so that the wave of $CO_2$ depression is delayed relative to the wave of the water tracer concentration. With the bicarbonate ions or selectively water-soluble water tracer, no such transfer can take place because of the substantially zero solubility of such tracers in oil. Such concentration changes become separated in a manner similar to that of the separation between a wave of increased concentration of an oil-tracer tracer and an increased concentration of non-partitioning water-tracer. As known in the art, the calculations involved in using such a $CO_2$ concentration-depression as the marker of the extent of chromatographic separation are the same type as those involved in using an increase in a tracer concentration for that purpose.

COMPARISON OF TRACER CAPABILITIES (1) Temperature Range

In typical prior processes an organic ester which is partially soluble in oil serves as the oil phase tracer which is injected at the wellbore and displaced to the desired distance from the wellbore by an inert fluid. A soak period then allows time for a hydrolysis reaction to take place and produce a significant amount of alcohol. The alcohol is not soluble in the oil and thus serves as the water phase tracer.

The hydrolyses step must not be too fast since it is undesirable for the alcohol to be produced during the placement step and also, some unreacted ester must remain after the soak period as it is the oil phase tracer. At the end of the soak period, both tracers are produced back to the wellbore. The amount of chromatographic separation of the two tracers is measured and used to calculate residual oil saturation.

If the reservoir temperature is above about 200° F., the hydrolysis rate of most, if not all, known esters is so fast that the above requirements cannot be met. Therefore, the prior processes have been limited to reservoirs of about 200° F. or less.

With respect to the present invention, a very large number of choices are available for selection of the "Base Generators" (i.e., pH-increasing reactants). A few examples are given in Table I, along with a best estimate of the applicable temperature range for each listed Base Generator:

TABLE I

| BASE GENERATOR | TEMPERATURE RANGE °F. |
|---|---|
| KOCN | 70 to 110 |
| UREA | 200 to 250 |
| $NaNO_2$ | 210 to 280 |

(2) Deeper Penetration (depth of investigation) from the Wellbore

The reactions by which a base is formed by typical base generating reactants suitable for use in the present process are listed in Table II.

TABLE II

| COMPOUND | | BASE |
|---|---|---|
| Urea | $CO(NH_2)_2 + 3H_2O$ | $NH_4HCO_3 + NH_4OH$ |
| Potassium Cyanate | $KOCN + 3H_2O$ | $NH_4HCO_3 + KOH$ |
| Sodium Nitrite | $3NaNO_2 + 3H_2O$ | $NaNO_3 + 2NO + 2NaOH$ |
| Urea and Sodium Nitrite | $2NaNO_2 + CO(NH_2)_2 + H_2O$ | $2N_2 + NaHCO_3 + NaOH$ |
| Propylene Oxide | O $CH_3CHCH_2 + NaCl + H_2O$ | $CH_3CHOHCH_2Cl + NaOH$ |

In commonly used prior processes the oil phase tracer is ethylacetate which is injected with an aqueous carrier fluid. It partitions between the oil in the reservoir and the water of the carrier fluid. The effect is to retard the advance of the ester front into the reservoir. In most cases the ester will reach a distance corresponding to a volume of only about one-third that of the volume of the total fluid injected.

In the present process the situation is different. The oil phase tracer is a reaction-induced dip in the concentration of $CO_2$ dissolved in an aqueous carrier fluid. Some reservoirs contain $CO_2$ which is partitioned to an equilibrated extent between the water and the oil phase fluids within the reservoir. When the fluid produced from such a reservoir is used as the aqueous solution containing $CO_2$ injected in accordance with the present process, the injection causes no further $CO_2$ partitioning. In other reservoirs a portion of water containing dissolved $CO_2$ but no dissolved base generating reactant is preferably injected ahead of the solution containing both dissolved $CO_2$ and dissolved Base Generating reactant. This ensures that $CO_2$ is present at the distance from the well in which the reservoir is to be tested. The $CO_2$ and base generating reactant-containing solution is displaced to the selected distance by injecting an aqueous fluid which contains about the same amount of dissolved $CO_2$ but is free of the base generating reactant. Since the base generating reactant is selectively water miscible, the subsequently formed depressed concentration of $CO_2$, i.e., the oil phase tracer of the present system, will penetrate farther into the formation than an ester system tracer (for a given volume of treatment) and will provide a residual oil measurement over about 3 times the volume of reservoir sampled by the prior system.

(3) Distribution Coefficient

The distribution coefficient, Ki, (ratio of concentration of tracer in the oil phase to that in the water phase) of esters is about 6 in most cases. Ki for $CO_2$ is about 2.

The $CO_2$ value for Ki is much more optimum from a test sensitivity point of view in most cases, since more of it is present in the water phase, which comprises substantially all of the produced fluid.

Also, the present type of tracer will be produced back to the wellbore much sooner than an equivalent ester tracer would be. If this property is combined with the smaller volumes needed for sampling the reservoir, because of deeper penetrating capability of the present tracer, only small jobs may be necessary. In this case, several small tests could be run on different wells instead of the one larger ester test as currently practiced. This would give better overall reservoir values for Sor (residual oil saturation) than is currently possible.

(4) Drift During Soak Period

In most reservoirs, fluid injected into a well will drift with the overall reservoir fluids when the pumps are shut down. This may be as much as a few feet per day.

In the prior ester systems, long soak periods are frequently required. This makes drift an important source of error, for which corrections must be made. Also, considerable accuracy and sensitivity is lost in the process.

In the present system, the wide choice of base generators which react at different rates at different temperatures coupled with more rapid backflow will greatly diminish the effect of drift in many cases. This is because base generators can be more optimally selected to correspond to the reservoir temperature involved. Also, the water tracer and oil tracer will stay much closer together in the reservoir and hence cancel much of the errors introduced by the reservoir drift velocity.

(5) Miscellaneous (a) The present relatively more precise positioning of the $CO_2$-depleting base generator in the reservoir may make it possible to use frontal analysis techniques on the tracers instead of band analyses used for the ester. Frontal analyses should be more accurate.

(b) In some cases, very small amounts of $CO_2$ may be sufficient due to the high sensitivity and stability of the analyses systems.

(c) If drift is minimal, simple methods of analyzing the data and calculating the residual oil saturation may be possible.

In general, with modifications apparent to those skilled in the art, the present process can be utilized in substantially any of the reservoir situations or fluid saturation determining processes for which the prior processes were suitable.

Table III lists results of testing various base generators at various temperatures and pH's. In each case, the solution was maintained at a pressure of 50 psig during the test. The pH of the solution was maintained substantially constant by adding portions at 0.1 mol/liter sodium bicarbonate solution to the system while the hydrolysis was proceeding. Each base generator solution consisted of water containing 0.5 mol/liter sodium chloride and 0.05 mols/liter of the base generator.

TABLE III

Hydrolysis Data - Screening Tests
Conditions: (1) Pressure, 50 PSIG
(2) .5 M/L NaCl Present in all Solutions

| Test | Base Generator | Temp. °F. | pH | Half Life,*1 $t_{\frac{1}{2}}$ hours |
|---|---|---|---|---|
| 1 | Urea | 210 | 6.2 | 12.3 |
| 2 | " | 208 | 5.5 | 8.4 |
| 3 | " | 208 | 7.0 | 45.2 |
| 4 | " | 211 | 8.0 | 15.9 |
| 5 | KOCN | 78 | 6.0 | 19.6 |
| 6 | " | 78 | 6.5 | 68.6 |
| 7 | " | 78 | 7.0 | 206.4 |
| 8 | KOCN | 99 | 7.0 | ~94.0 |
| 9 | " | 99 | 7.5 | ~223.0 |
| 10 | " | 116 | 8.0 | ~223.0 |
| 11 | $NaNO_2$ | 212 | 6.0 | 80.0 |
| 12 | " | 279 | 6.0 | 49.2 |
| 13 | " | 279 | 5.5 | 17.5 |
| 14 | " | 279 | 7.0 | 141.4 |
| 15 | " | 280 | 6.5 | 84.9 |
| 16 | " | 296 | 6.5 | 73.2 |
| 17 | Urea + $NaNO_2$ | 138 | 6.5 | no reaction |
| 18 | Urea + $NaNO_2$ | 184 | 6.5 | 41.0 |
| 19 | Urea + $NaNO_2$ | 180 | 6.0 | 52.3 |
| 20 | Urea + $NaNO_2$ | 190 | 6.0 | 19.3 |
| 21 | Propylene oxide | 106 | 6.0 | 26.5 |
| 22 | " | 122 | 6.0 | 26.0 |
| 23 | " | 122 | 7.0 | 35.6 |
| 24 | " | 76 | 7.0 | 86.1 |

*1This is the time, in hours, required for the base generator to be ½ reacted. This is a convenient way to measure the speed of a reaction.

The patterns of the concentrations of dissolved $CO_2$ and dissolved bicarbonate with amounts of fluid produced from the reservoir being tested (and/or concentrations with time where the production rate is substantially constant) can be measured by currently known and available methods and apparatus for radioactive or chemical analyses. It is a distinctive advantage of the present process that known and available relatively simple procedures, such as titrometric and/or thermetric analyses, can be utilized where desired to supplement radioactivity measurements of the chromatographic separation between the $CO_2$ partitioned between the phases and the acid anions and/or other water tracers dissolved substantially completely in the mobile phase of the reservoir fluid.

In a preferred procedure for measuring residual oil saturation, water produced from (or equivalent to) the water in the reservoir is used as the injected aqueous fluid. Where that water is substantially free of dissolved $CO_2$, a selected amount, such as about 0.001 M/L to 0.100 M/L is dissolved in the water. While injecting that solution, a base generating reactant is incorporated in the inflowed water in a concentration of about 0.0005 M/L to 0.0500 M/L and a volume sufficient to form a slug occupying the desire pore volume of the reservoir. The base generating reactant-containing solution is displaced a selected distance, such as about 5 to 25 feet from the well, by injecting the $CO_2$-containing water while omitting the base generating reactant. After time enough for the depletion of a significant proportion, or all, of the $CO_2$ in the base generating reactant-containing fluid, the injected fluid is backflowed and analyzed.

In general, it is preferable to select the base generating reactant relative to the pumping rate to be used, the distance from the well at which the measurement is to be made, and the temperature to be encountered within the reservoir. This indicates the time and temperature exposure to be encountered by the base generating reactant during the inflowing of the solution containing it. Relative to the exposure to be encountered, the reactant can be selected so that no more than about 20–30 percent or or in the order of about ⅓ of that reactant will be spent while the fluid containing it is being pumped into the reservoir. In such a situation, the soak period for the completion of the reaction need only be about 3 times as long as the pump-in time.

In the present process the selectively water-miscible radioactive tracers and/or precursors of such tracers which are injected as solutes in the first aqueous solution which is flowed into the reservoir can be used as water tracers in conjunction with, or in place of, selectively water soluble byproducts of the pH-induced conversion of dissolved $CO_2$ (the dissolved bicarbonate ions). Such radioactively tagged water tracers can be substantially any selectively water soluble compound which eminates rays such as alpha, beta, gamma or X-rays. Suitable examples include tritiated water, water solutions containing cobalt-57 and -60 cobaltohexacyanide (usually the potassium salt) hexacyanocobaltate or $I^{125}$ salts (i.e. $NaI^{125}$).

When an X-ray or low energy gamma ray emitter is used, i.e., cobalt 57, a solid scintillation counter such as $NaI(T_1)$ can be attached directly to the wellhead or production fluid flow lines for detecting the arrival of the water tracer. A suitable concentration of radioactively tagged water tracer is about 1 to $5\times10^{-4}$ microcuries/cc mol/liter of the tracer-providing aqueous liquid solution (i.e., the first injected aqueous liquid solution). When a beta emitter, like tritium, is used as the water a concentration of about 1 to $3\times10^{-3}$ microcuries/cc can be used.

Based on the results of the preliminary field tests and data available regarding suface equipment and injection and production procedures known to be useful in connection with the previously known single well tracer test method for measuring residual oil saturation, a computer program was written to calculate peak heights and arrival times of tracers travelling through porous media containing various amounts of immobile oil. Use was made of the conventional chromatographic models with the system of interest being divided into numerous small elements of volume. In the program, the equilibrium conditions for each element are calculated as fluid moves from one to the other in transit through the zone of interest. For example, a sand pack or well test and a parameter is incorporated into the program to account for mixing as the fluid flows from element to element.

The following is an example of how a single well residual oil saturation test can be conducted in accordance with the present process. Assume that the well to be tested has a temperature of about 142° F., an open interval of about 20 feet, and is capable of sustaining an injection rate of about one-half barrel per minute. The tracer providing solution can contain about 100 barrels of 0.025 m/l $CO_2$, $3\times10^{-4}$ microcuries/cc tritium (water tracer), and 0.025 m/l urea (base generating reactant) dissolved in reservoir formation water (which is to be filtered to remove contaminants such as ferric oxide when pumped into the well). That solution would be displaced into the reservoir by injecting about 400 barrels of filtered formation water which would cause a radial displacement (or penetration of the tracer from the wellbore) to be about 15 feet. A soak time of 3 days would be appropriate, followed by the production of the injected fluids at a rate of about 0.5 to 1 b/m by gas lift, with the volume of produced fluid being monitored from the separator at the well site. A continuous side stream of the produced fluid can be analyzed for radioactivity and/or $CO_2$ bicarbonate 2-chloropropionic acid anion and pH. The testing can utilize standard pumping equipment available from service companies.

Figure 2:
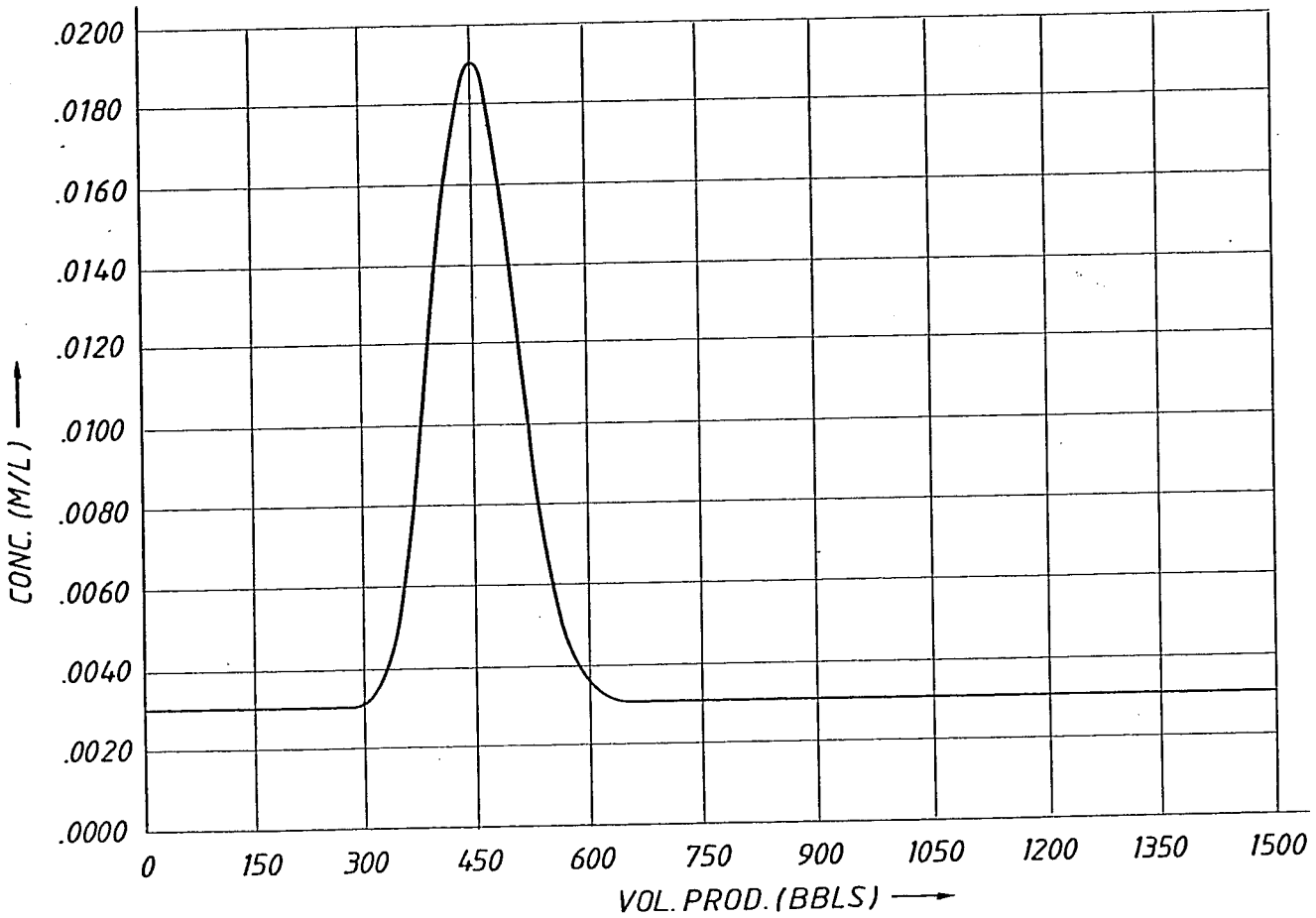
FIG. 2 shows a graph of calculated concentration of water tracer with volume of produced fluid.
Figure 3:
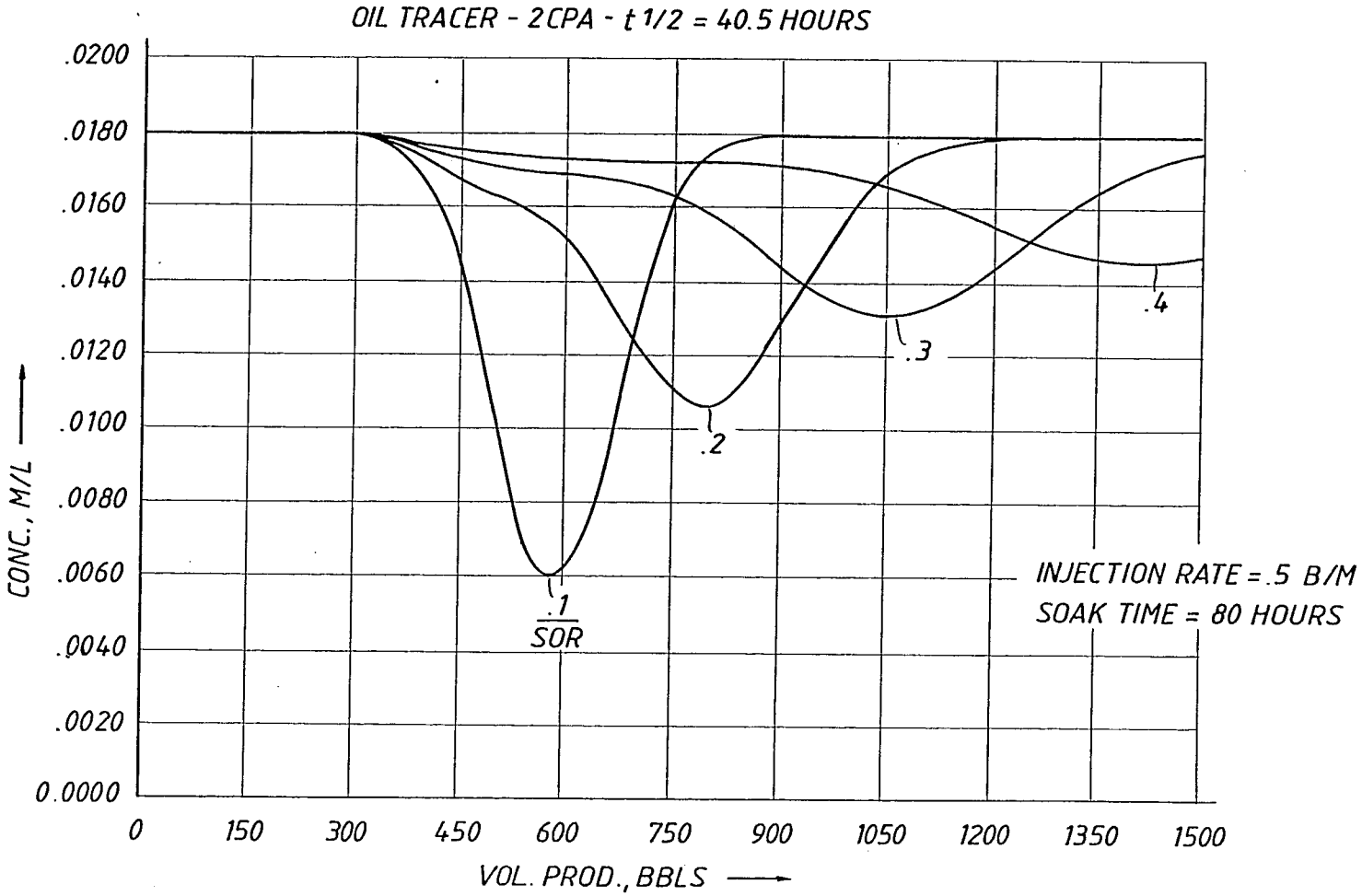
FIG. 3 shows a graph of calculated concentration of oil tracer with volume of fluid produced from earth formations containing different amounts of oil saturation.

FIG. 2 shows the calculated response for an analysis to determine the separation between the oil and water tracers at the wellbore during such a treatment. The measured pore volume of the reservoir being tested is given as the production volume attained at the peak of the water tracer curve shown in FIG. 2. The oil present in this volume of the reservoir is given by the volume difference between the water tracer peak (FIG. 2) and the oil tracer valley as shown in FIG. 3. Curve matching, using appropriate chromatographic models, can be utilized to establish the residual oil saturation in the tested portion of the reservoir.

FIG. 3 shows the results of model calculations regarding the effect of various residual oil saturation values on oil tracer valley depths and positions. The valley depth at Sor equal zero is essentially the same as the water tracer peak for 1 pore volume. With an increase in oil content, the valley broadens and moves more slowly, so that about 2 pore volumes must be produced to obtain the valley at the wellbore. Oil saturation values in the range of 0.1 to 0.3 are well suited for determinations by the present method. These calculations were based on determinations utilizing chemical analyses of the tracer—which can provide a desirable backup to determinations based on radiation analyses. As known in the art, by utilizing appropriate types of radiation emitters, it may be possible to further extend the range of oil saturations to which the present process if applicable.

An embodiment of the present invention which is particularly desirable where the reservoir water has a relatively high $CO_2$ content as produced and/or the reservoir rocks contain a significant concentration of water soluble carbonate mineral, involves injecting a tracer providing solution containing a radioactively tagged $CO_2$ such as a $C_{14}$-labeled $CO_2$. In such a procedure the tracer-providing solution preferably contains a radioactively tagged selectively water-miscible water tracer which emits radiation distinguishable from that of carbon 14 and the arrivals of the reaction-depleted $CO_2$ concentration and the water tracer are detected by radioactivity measurements. In addition, an aqueous fluid devoid of a significant amount of bicarbonate ion is injected to an extent and in a sequence such that the solution containing the $C_{14}$-labeled $CO_2$ is displaced by aqueous fluid at least substantially devoid of bicarbonate ion. For example, as indicated previously, the injection of the solution containing the labeled $CO_2$ should be preceded by and followed by an injection of bicarbonate-free solution so that whether the solution in which the oil and water tracers are provided (by the conversion of $CO_2$ to bicarbonate ion) is backflowed into the well through which it was injected, or is displaced into an adjacent production well, the fluid which displaces it consists essentially of fluid free of bicarbonate ion.

Where labeled $CO_2$ is used it can be formed by known procedures, for example, by acidizing a solution containing a $C_{14}$-labeled bicarbonate salt, converting another labeled precursor of $CO_2$. If desired, the resulting radioactive $CO_2$ can be utilized as some or all of the $CO_2$ which is contained in the tracer providing solution. Where the tracer providing solution is formulated by dissolving the specified solutes in water produced from the reservoir and that water contains a relatively high proportion of $CO_2$, at least some of that $CO_2$ is preferably stripped out and replaced by the radioactively tagged $CO_2$. Preferably, the amount of radioactively tagged $CO_2$ in the solution as injected amount to about 4 to $8\times10^{-4}$ microcuries/cc.

In addition, where $C_{14}$-labeled $CO_2$ is used, in order to cause the arrival of the labeled $CO_2$ to coincide with the chromatographically delayed $CO_2$, the aqueous liquid which displaces the $CO_2$ to the measuring location should contain only an insignificant amount of dissolved bicarbonate ion. The suitability of water produced from the reservoir or other water can be determined by laboratory tests such as flowing both the water being tested and the labeled $CO_2$ through a permeable earth formation core or sand pack containing that water, or an equivalent water, and the reservoir oil, or an equivalent oil.

Such a utilization of $CO_2$ containing a radioactive carbon atom can ensure that the increase in bicarbonate ion containing salts which is produced by the in situ reaction conversion of the $CO_2$ to dissolved bicarbonate ion, can readily be distinguished by the presence of the radioactively labeled carbon atoms in the bicarbonate ions. The increase in bicarbonate radioactivity should be equivalent to the decrease in $CO_2$ concentration.

A tracer forming solution suitable for use in this invention contains solutes consisting essentially of $CO_2$, a base generator, and a compatible water soluble radioactive tracer which is substantially oil insoluble, dissolved in an aqueous solution in which, optionally, the $CO_2$ contains radioactively labeled carbon atoms. The tracer forming solution, as initially injected, preferably contains enough substantially neutral salt and pH-adjusting acid or base material to provide a composition which is at least compatible with, if not substantially similar to, or a portion of, the aqueous liquid present in the reservoir to be tested. The combination of the kinds and amounts of base-generating material and tagged or untagged $CO_2$ are preferably tailored with respect to the reservoir temperature to provide (a) a readily detectable decrease in the dissolved $CO_2$, (b) optionally, such an increase in the concentration of reaction-formed labeled bicarbonate ion solution, and (c) optionally, a detectable amount of injected radioactive water-phase tracers relative to the respective mobile and immobile liquid phases in the reservoir. In addition, what is important is that, at least by the end of the soak period within the reservoir, the tracer-forming solution contains a detectable decrease in dissolved $CO_2$ content plus enough carbon 14 labeled carbonic acid salt and/or injected radioactive water phase fluid tracer material to provide recognizable arrivals of the respective fluid phase tracers in the presence of the other soluble materials present in the reservoir.

The patterns of the concentrations with amounts of fluid produced from the reservoir being tested (and/or concentrations with time, where the production rate is substantially constant) can be measured by currently known and available chemical and/or radioactive analytical methods and devices. It is a distinctive advantage of the present process that known and available relatively simple procedures, such as radiation counting, titrometric and/or thermometric analyses, can be utilized to measure all or part of the data needed for determining the chromatographic separation between the $CO_2$ partitioned between the phases and the acid anions or other water tracer dissolved substantially completely in the mobile phase of the reservoir fluid.

What is claimed is:

1. A process for determining the relative concentrations of oil and water phases in a subterranean reservoir comprising:

(A) injecting into the reservoir a first reactant-containing aqueous solution which, at least soon after entering the reservoir, contains solutes that include, or become inclusive of, at least one each of
(1) a detectable radioactive material,
(2) a detectable amount of dissolved $CO_2$,
(3) a selectively water-soluble reactive material capable of substantially increasing the solution pH and thus causing a significant proportion of the dissolved $CO_2$ to be converted to dissolved bicarbonate ion, and
(4) a detectable amount of a selectively water-soluble tracer material, whereby an aqueous solution of tracers, having different partition coefficients relative to the oil and water phases within the reservoir, is formed;

(B) displacing the first aqueous solution to a selected location within the reservoir by injecting a second aqueous solution which contains substantially the same concentration of $CO_2$ present in the first aqueous solution prior to conversion of the $CO_2$ to bicarbonate but is free of any radioactive material, reactive material, or tracer material, whereby said first aqueous solution of tracers contacts the reservoir oil and $CO_2$ conversion occurs;

(C) producing fluid from the reservoir; and (D) radioactively measuring the chromatographic separation between the arrival of at least one selectively water soluble tracer, and the arrival of the depletion in $CO_2$ concentration resulting from the $CO_2$ conversion, whereby the relative concentrations of the oil and water phases within the reservoir are determined.

2. The process of claim 1 in which the pH of the fluid being injected is adjusted to approximate that of the aqueous fluid in the reservoir being tested.

3. The process of claim 1 in which the amount of $CO_2$ and the kinds and amounts of the base-generating reactant are arranged to provide said significant decrease in $CO_2$ concentration within a selected relatively short time after being displaced into the selected location in the reservoir.

4. The process of claim 1 in which the produced fluid is produced by backflowing fluid into a well through which the aqueous solution were injected into the reservoir.

5. The process of claim 1 in which the produced fluid is produced from a well other than the one through which the aqueous solutions were injected.

6. The process of claim 1 in which the concentration of dissolved bicarbonate ion resulting from the conversion of dissolved $CO_2$ is detected as one tracer of the mobile fluid phase.

7. The process of claim 1 in which the concentrations of the tracers in the produced fluid are measured at the well site and the temperature of the reservoir being treated is undesirably high relative to a use of an organic ester tracer-forming material.

8. The process of claim 1 in which the selectively water-soluble tracer material is selected such that it is capable of reacting with water to form a water-soluble-only tracer material.

9. A process for determining the relative concentrations of oil and water phases in a subterranean reservoir comprising:

(A) injecting into the reservoir a first aqueous solution which is substantially devoid of bicarbonate ion;

(B) injecting into the reservoir a second reactant-containing aqueous solution which, at least soon after entering the reservoir, contains solutes that include, or become inclusive of, at least one each of
(1) a detectable radioactive tracer material,
(2) a detectable amount of dissolved $CO_2$ containing radioactive carbon atoms,
(3) a selectively water-soluble reactive material capable of substantially increasing the solution pH and thus causing a significant proportion of the dissolved $CO_2$ to be converted to dissolved bicarbonate ion, and
(4) a detectable amount of a selectively water-soluble tracer material, whereby an aqueous solution of tracers, having different partition coefficients relative to the oil and water phases within the reservoir, is formed;

(C) displacing the first aqueous solution to a selected location within the reservoir by injecting a third aqueous solution which is substantially devoid of bicarbonate ions, radioactive material, reactive material, or tracer material, whereby said second aqueous solution of tracers contacts the reservoir oil and $CO_2$ conversion occurs;

(D) producing fluid from the reservoir; and (E) radioactively measuring the chromatographic separation between the arrival of at least one selectively water soluble tracer, and the arrival of the depletion in $CO_2$ concentration resulting from the $CO_2$ conversion, whereby the relative concentrations of the oil and water phases within the reservoir are determined.

10. The process of claim 9 in which the second injected aqueous solution contains $C_{14}$ labeled $CO_2$.

11. The process of claim 10 in which the first injected aqueous solution contains a selectively water-soluble radioactive material which provides emissions distinguishable from those of $C_{14}$ and both types of those emissions are used in detecting the arrival of the mobile phase fluid tracer.

* * * * *